US010287842B2

(12) United States Patent
Bieneman et al.

(10) Patent No.: US 10,287,842 B2
(45) Date of Patent: May 14, 2019

(54) MODULAR BLOWOUT PREVENTER CONTROL SYSTEM

(71) Applicant: Cameron International Corporation, Houston, TX (US)

(72) Inventors: Konstantin Bieneman, Singapore (SG); Cedric Morin, Singapore (SG); Wei Kwan Toh, Singapore (SG); Yee Kang Tam, Singapore (SG)

(73) Assignee: Cameron International Corporation, Houston, TX (US)

( * ) Notice: Subject to any disclaimer, the term of this patent is extended or adjusted under 35 U.S.C. 154(b) by 226 days.

(21) Appl. No.: 15/271,546

(22) Filed: Sep. 21, 2016

(65) Prior Publication Data

US 2018/0038187 A1 Feb. 8, 2018

(30) Foreign Application Priority Data

Aug. 4, 2016 (EP) ..... 16306011

(51) Int. Cl.

| | |
|---|---|
| ***E21B 33/06*** | (2006.01) |
| ***E21B 34/16*** | (2006.01) |
| ***E21B 47/00*** | (2012.01) |
| ***E21B 33/064*** | (2006.01) |

(52) U.S. Cl.

CPC ..... *E21B 33/061* (2013.01); *E21B 33/064* (2013.01); *E21B 34/16* (2013.01); *E21B 47/00* (2013.01)

(58) Field of Classification Search

None

See application file for complete search history.

(56) References Cited

U.S. PATENT DOCUMENTS

| | | | | |
|---|---|---|---|---|
| 3,957,079 | A * | 5/1976 | Whiteman | E21B 33/0355 137/596.18 |
| 5,398,761 | A * | 3/1995 | Reynolds | E21B 33/0355 166/344 |
| 6,422,315 | B1 | 7/2002 | Dean | |
| 8,393,399 | B2 * | 3/2013 | Judge | E21B 33/076 166/344 |
| 2004/0154804 | A1 | 8/2004 | Williams | |
| 2006/0201682 | A1 * | 9/2006 | Reynolds | E21B 33/035 166/368 |
| 2014/0048274 | A1 * | 2/2014 | Reynolds | E21B 33/064 166/338 |
| 2016/0109874 | A1 * | 4/2016 | Holmes | G05B 19/406 700/275 |

(Continued)

OTHER PUBLICATIONS

Shanks et al., "New Generation Control System for 20 KSI Subsea BOP", OTC 23473, Proceedings of 2012 Offshore Technology Conference, Houston, Texas, Apr. 30, 2012, pp. 1-12.

*Primary Examiner* — Shane Bomar

(74) *Attorney, Agent, or Firm* — Helene Raybaud

(57) ABSTRACT

Disclosed here are systems and methods for modular blowout preventer (BOP) control. A modular BOP control unit system of one embodiment includes a group of modular control units mounted on a skid. The modular control units can include a main control unit module for an annular BOP, a diverter valve module for a diverter, and a BOP valve module for one or more ram BOPs. In some instances, the modular control units are received in pockets of the skid. Additional systems, devices, and methods are also disclosed.

19 Claims, 16 Drawing Sheets

(56) References Cited

U.S. PATENT DOCUMENTS

2017/0234335 A1* 8/2017 LeBlanc ..... E21B 34/16
137/315.03
2018/0284735 A1* 10/2018 Cella ..... G05B 23/024

* cited by examiner

MODULAR BLOWOUT PREVENTER CONTROL SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

By way of example, an offshore drilling system typically includes a marine riser that connects a drilling rig to subsea wellhead equipment, such as a blowout preventer stack connected to a wellhead. A drill string can be run from the drilling rig through the marine riser into the well. Drilling mud can be routed into the well through the drill string and back up to the surface in the annulus between the drill string and the marine riser. Unexpected pressure spikes can sometimes occur in the annulus, such as from pressurized formation fluid entering the well (also referred to as a "kick"). Blowout preventers (referred to in the field as "BOPs") and diverters are typical safety measures for addressing kick and other dangerous pressure changes.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to a modular BOP control system for controlling an annular BOP, a diverter, and a ram BOP. The modular BOP control system can include a skid. The modular BOP control system can also include a group of modular units each having a frame that is mounted on the skid. The group of modular units can include a main control unit module that controls and monitors the annular BOP. The group of modular units can also include a diverter valve module that controls and monitors the diverter. The group of modular units can further include a BOP valve module that controls and monitors one or more ram BOPs.

Certain embodiments of the present disclosure generally relate to a method. The method can include positioning a skid over a wellhead. The skid can include an upper surface having a plurality of module pockets. The method can further include lowering each of at least two modular units into a respective module pocket of the skid. The at least two modular units can include at least two of a main control unit module, a diverter valve module, a BOP valve module, an accumulator system module, and a BOP selector module. The method further includes, upon failure of any single modular unit, lifting the failed modular unit out of its module pocket and replacing the failed modular unit with a replacement modular unit.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Embodiments of the present disclosure generally relate to modularized control units for BOP controls and a skid for connecting the modularized control units. By segregating functions into modules, a scalable control unit results that is both easily repairable and customizable. The present disclosure additionally addresses simplified universalized connections for both electrical and hydraulic lines to enable swapping out of the modularized control units, all in a skid with a smaller footprint than in legacy designs that are not modularized or customizable at the wellsite.

Figure 1A:
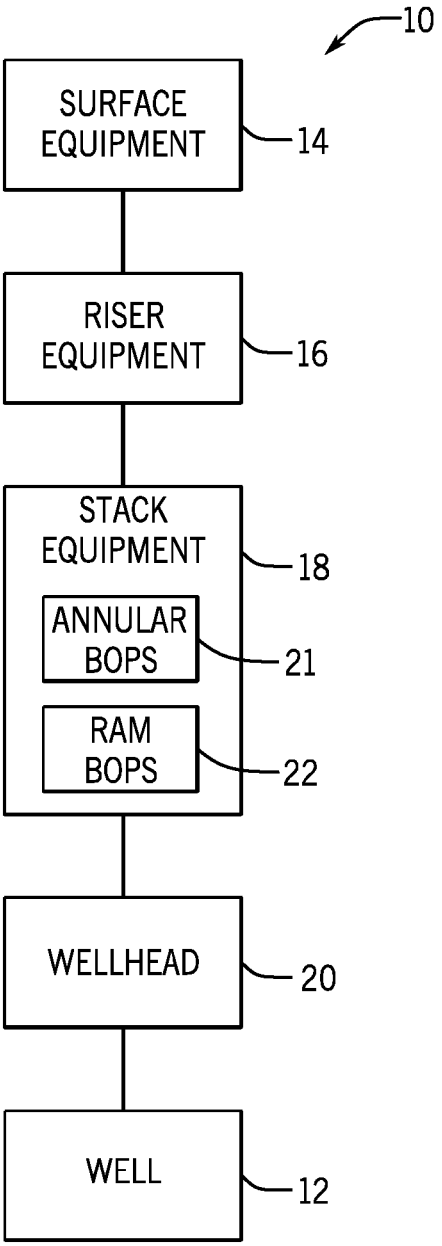
FIG. 1A generally depicts a subsea system for accessing or extracting a resource, such as oil or natural gas, via a well in accordance with an embodiment of the present disclosure.

Turning now to the present figures, a system 10 is illustrated in FIG. 1A in accordance with one embodiment. Notably, the system 10 (e.g., a drilling system or a production system) facilitates accessing or extraction of a resource, such as oil or natural gas, from a well 12. Although the system 10 may take the form of an onshore system in other embodiments, the system 10 is depicted in FIG. 1A as an offshore system that includes surface equipment 14, riser equipment 16, and stack equipment 18, for accessing or extracting the resource from the well 12 via a wellhead 20. In one subsea drilling application, the surface equipment 14 includes a drilling rig above the surface of the water, the stack equipment 18 (i.e., a wellhead assembly) is coupled to the wellhead 20 near the sea floor, and the riser equipment 16 connects the stack equipment 18 to the drilling rig and other surface equipment 14.

As will be appreciated, the surface equipment 14 can include a variety of devices and systems, such as pumps, power supplies, cable and hose reels, a rotary table, a top drive, control units, a gimbal, a spider, and the like, in addition to the drilling rig. The stack equipment 18, in turn, can include a number of components, such as blowout preventers 21 and 22, that enable control of fluid from the well 12. Similarly, the riser equipment 16 can also include a variety of components, such as riser joints, flex joints, a telescoping joint, fill valves, a diverter, and control units, some of which are depicted in FIG. 1B in accordance with one embodiment.

Figure 1B:
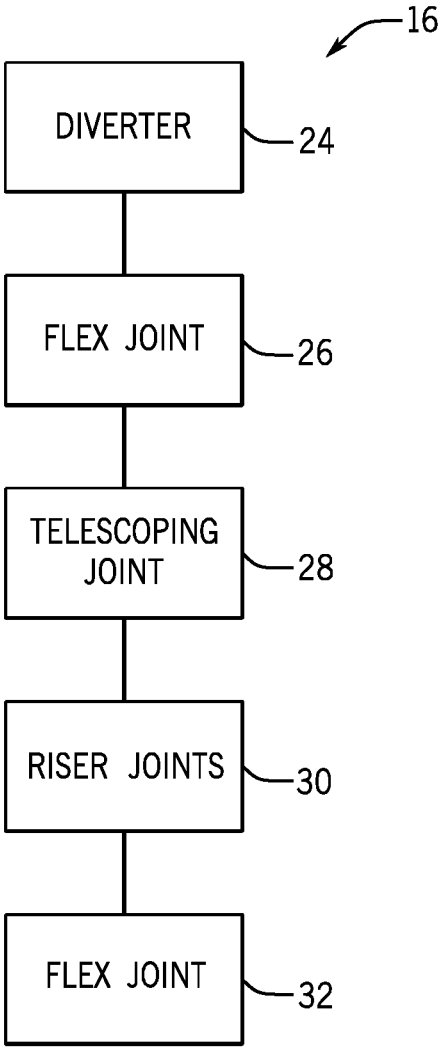
FIG. 1B is a block diagram of a diverter and other various components of riser equipment of FIG. 1A in accordance with one embodiment.

Particularly, in the embodiment of FIG. 1B, the riser equipment 16 is provided in the form of a marine riser that includes a diverter 24, an upper flex joint 26, a telescoping joint 28, riser joints 30, and a lower flex joint 32. A marine riser is generally a tube (typically including a series of riser joints 30) that connects an offshore drilling rig to wellhead equipment installed on the seabed. In some instances, a floating drilling rig (e.g., a semisubmersible or drilling ship) is used to drill the well 12. To accommodate motion of the floating rig, the upper flex joint 26 can be connected to or near the surface equipment 14 and the lower flex joint 32 can be coupled to or near the stack equipment 18. Complementing the flex joints 26 and 32, the telescoping joint 28 compensates for heave (i.e., up-down motion) of the drilling rig generally caused by waves at the surface. In some instances, such as in embodiments involving jack-up rigs, flex joints 26 and 32 and telescoping joints 28 may be optionally omitted, and stack equipment 18 (including, for example, blowout preventers 21 and 22) can be provided at the surface (e.g., as part of surface equipment 14).

At various operational stages of the system 10, fluid can be transmitted between the well 12 and the surface equipment 14 through the riser equipment 16. For example, during drilling, a drill string is run from the surface, through a riser string of the riser equipment 16, and into the well 12 to bore a hole in the seabed. Drilling fluid (also known as drilling mud) is circulated down into the well 12 through the drill string to remove well cuttings, and this fluid returns to the surface through the annulus between the drill string and the riser string.

The diverter 24 operates to protect the drilling rig and other surface equipment 14 from pressure kicks traveling up from the well 12 through the marine riser. Such pressure kicks can be caused by pressurized formation fluids entering the well 12. The diverter 24 includes an annular preventer for sealing the fluid path from the well 12 when a pressure kick is detected. The pressurized fluid during a kick can be routed away from the drilling rig through one or more ports in the diverter 24.

Surface equipment 14 includes a control manifold with electrical and hydraulic controls for monitoring pressure and actuating one or more blowout preventers of the stack equipment 18 and the diverter 24. In legacy designs, the control manifold may be redesigned, reconfigured, and rebuilt for each jack-up specification or stack change, which is labor-intensive and skill-intensive work. Valuable rig time is consumed in redesign of piping and cabling at the site of the well.

In practice, stack equipment 18 typically includes a stack of blowout preventers of various types. A first type, a ram-type blowout preventer uses one or more pairs of opposing rams that press against one another to restrict flow of fluid through the blowout preventer. The rams can include main bodies (or ram blocks) that receive sealing elements that press together when a pair of opposing rams close against one another to seal large diameter hydraulic cylinders about the tubular in the event of a kick (or alternatively shear the tubular). By comparison, a second type of BOP, an annular preventer is a valve that is mechanically compressed inward to seal off a conduit (e.g., against a tubular) using a packer.

Stack equipment 18 may include one to six ram-type preventers, and one or two annular-type preventers, with the ram-type preventers on the bottom and the annular-type preventers at the top (relative to one another). In accordance with the present disclosure, the controls for the various components of stack equipment 18 can be modularized by segregating the controls for various aspects of BOP stack control into modules by function.

To facilitate efficient rig-up, each modular control unit can include hydraulic tubing standardized for inter-connecting between a group of modular units, as well as cabling for communication and/or power between the modular units. In a particular embodiment described herein, the group of modular units includes three discrete units, though any number of functional modules is also contemplated by the present disclosure. Each modular unit may also include ergonomically positioned pressure gauges, in that switches, control valves, or other controls are logically grouped near gauges relating to what is controlled by each of those controls. Finally, each modular unit can optionally include a splash barrier (168 in FIG. 6D). Each of these aspects will be discussed in turn below.

Figure 2:
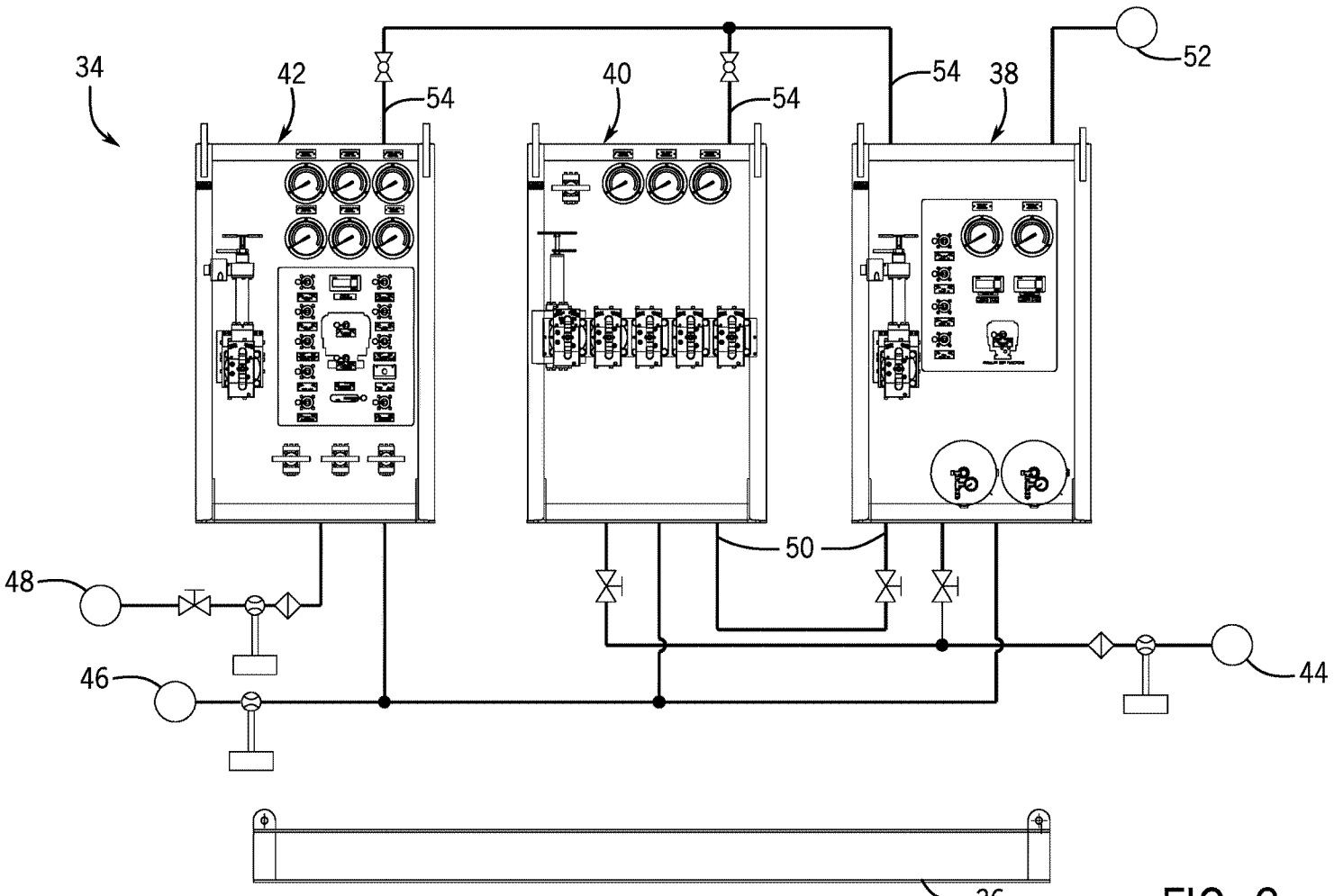
FIG. 2 is a schematic for a modular BOP control unit and accompanying skid that may be employed in surface equipment of FIG. 1A in accordance with one embodiment.

FIG. 2 is a schematic for a modular control unit (MCU) 34 that may be employed in surface equipment 14 of FIG. 1A in accordance with one embodiment. The MCU 34 includes a group of control modules supported in a skid 36, which will be described more fully below. The group of control modules can include a main control unit 38, a BOP valve unit 40, and a diverter valve unit 42. In other embodiments, the group of control modules can also or instead include an accumulator system module or a BOP selector module. The group of modules are positioned in the skid 36 such that the connections for power, communication, and hydraulic control are accomplished by placement of each module in position on the skid 36. In a particular embodiment, the connectors for power, communication, and hydraulic control may include hot-stab style connectors.

In the depicted embodiment, the units 38, 40, and 42 are equally sized and have identical footprints. The skid 36 is configured to mechanically support the group of modular control units, and includes at least a hydraulic connection and an electrical connection devoted to each modular unit. The skid further comprises interconnects standardized to connect between the modular control units, thereby reducing cabling and piping needs at the rig site.

Figure 3A:
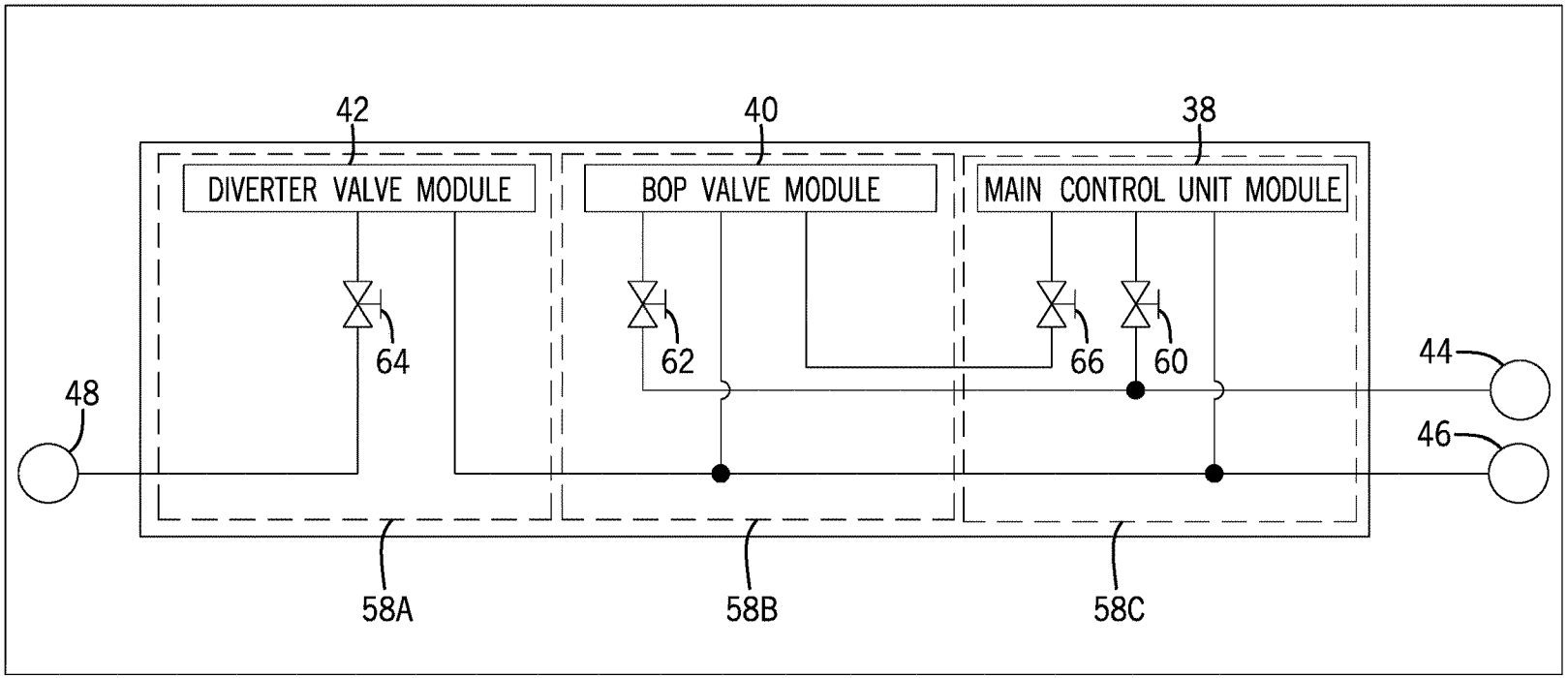
FIGS. 3A and 3B are schematics of skid interconnections in accordance with various embodiments.

FIG. 3A is a schematic of skid interconnections in accordance with one embodiment. The skid 36 of FIG. 2 provides mechanical support to the control module units. In at least some embodiments, the skid 36 is a steel frame having three module pockets 58 that physically separate the modules from one another with a barrier, ridge or the like defining the module pockets 58. The edges of the module pockets 58 serve to align each module unit properly when placed on the skid 36 (typically using a crane or other lifting assembly). Each module pocket 58 is configured to receive one of the modular units described herein. Each module pocket 58 can include connections to a plurality of interconnects positioned similarly in the module pocket 58 to enable modular units to be swapped out for one another without re-routing any piping or cabling. Each module pocket 58 may include a valve or set of valves to couple to a given module positioned there. In the embodiment shown, module pocket 58C, configured to receive a main control unit module 38, includes a first valve 60 to couple the module unit positioned there to interconnect BOP stack system hydraulic line 44. Module pocket 58B includes a second valve 62 to couple the module unit positioned there to interconnect BOP stack system hydraulic line 44. Module pocket 58A includes a third valve 64 to couple the module unit positioned there to a diverter system hydraulic pressure line 48. Module pocket 58C also includes a fourth valve 66 to couple the module unit positioned there to interconnect to an adjacent BOP valve module 40 positioned in module pocket 58B.

Figure 3B:
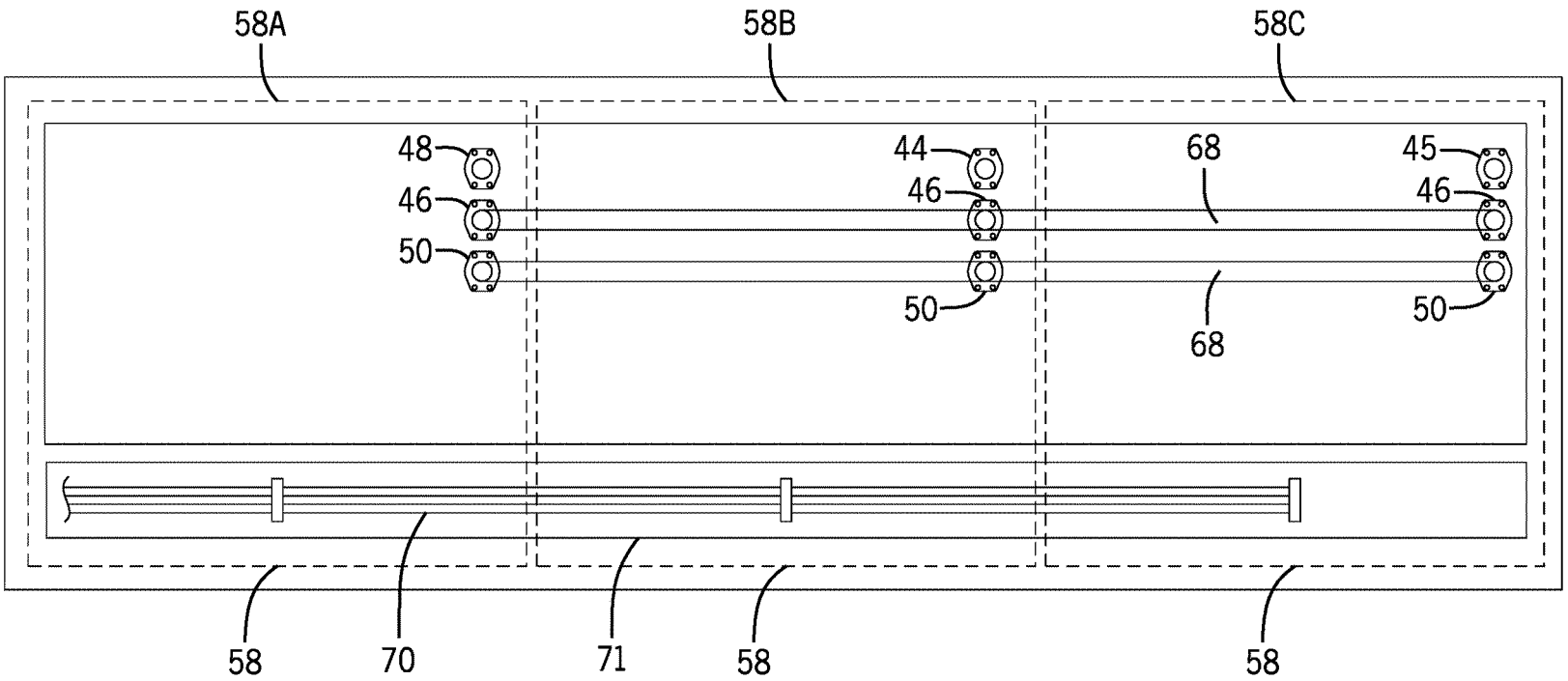

FIG. 3B is a schematic of skid interconnections in accordance with one embodiment. As shown in FIG. 3B, the module pocket 58A, module pocket 58B and module pocket 58C each have three interconnects. Module pocket 58A is configured to receive a diverter valve module 42 (to be discussed further below), and includes connections to interconnects for a hydraulic return line 46 and a BOP manifold line 50, as well as a connection to the diverter system hydraulic pressure line 48. Module pocket 58B is configured to receive a BOP valve module 40, and includes connections to the BOP stack system hydraulic line 44 and the interconnects for hydraulic return line 46 and BOP manifold line 50. Module pocket 58C is configured to receive a main control unit module 38, and includes connections to annular BOP line 45 and the interconnects for hydraulic return line 46 and BOP manifold line 50. Rig air supply 52 is coupled to main control module 38, and a standardized hydraulic or pneumatic interconnect 54 between modules is also provided.

Skid piping built into skid 36 connects each of the modules efficiently during rig-up, as interconnects 68 couple to each modular unit when placed on the skid 36. Likewise, skid cabling 70 installed in the skid 36 (e.g., in a cable channel 71) connects each of the modules with less involved rig-up than a conventional control unit for BOPs, as interconnects couple to each modular unit when placed on the skid 36. The skid cabling 70 may, for example, include electrical wiring, fiber optic cables, or the like.

Figure 4A:
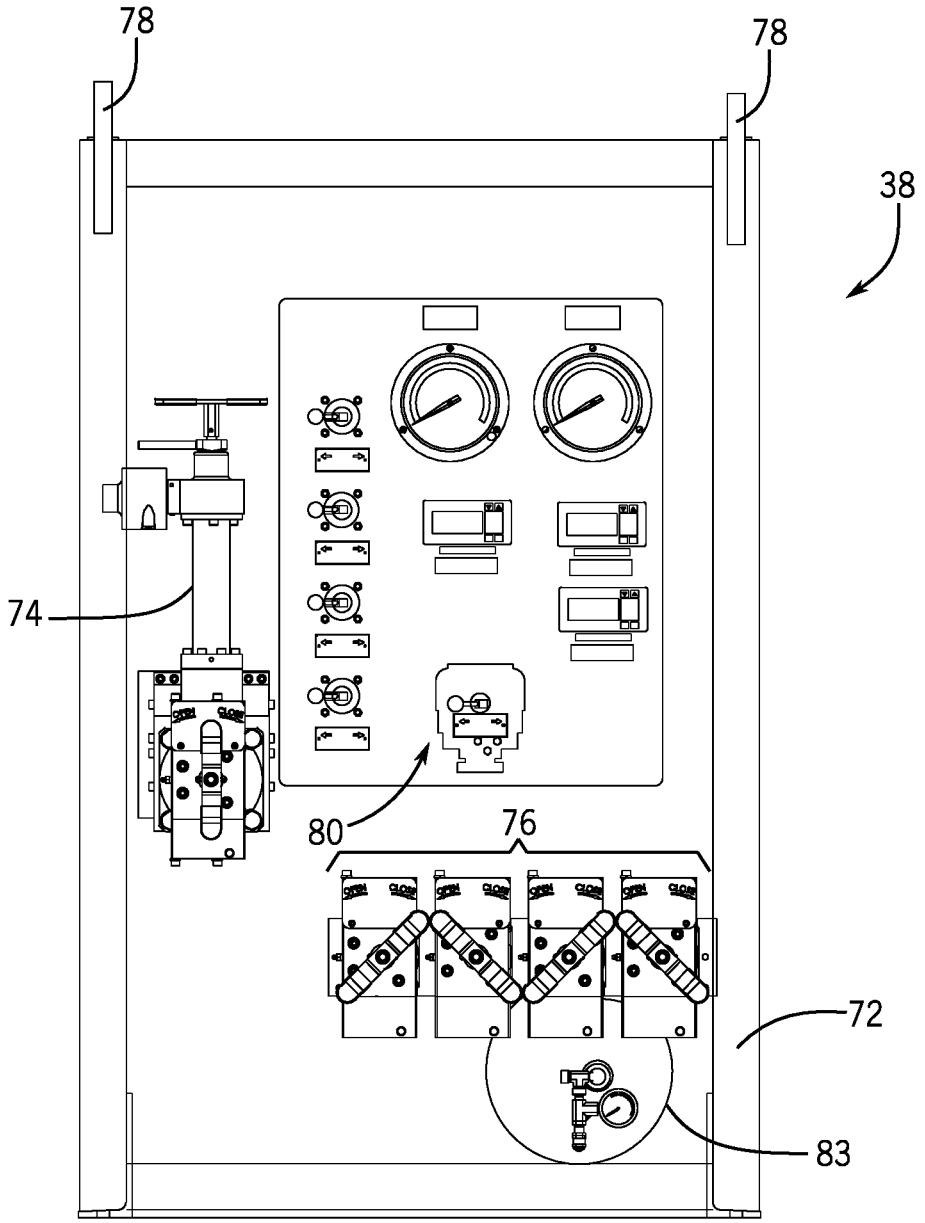
FIGS. 4A-4D depict aspects of a main control module in accordance with one embodiment.
Figure 4B:
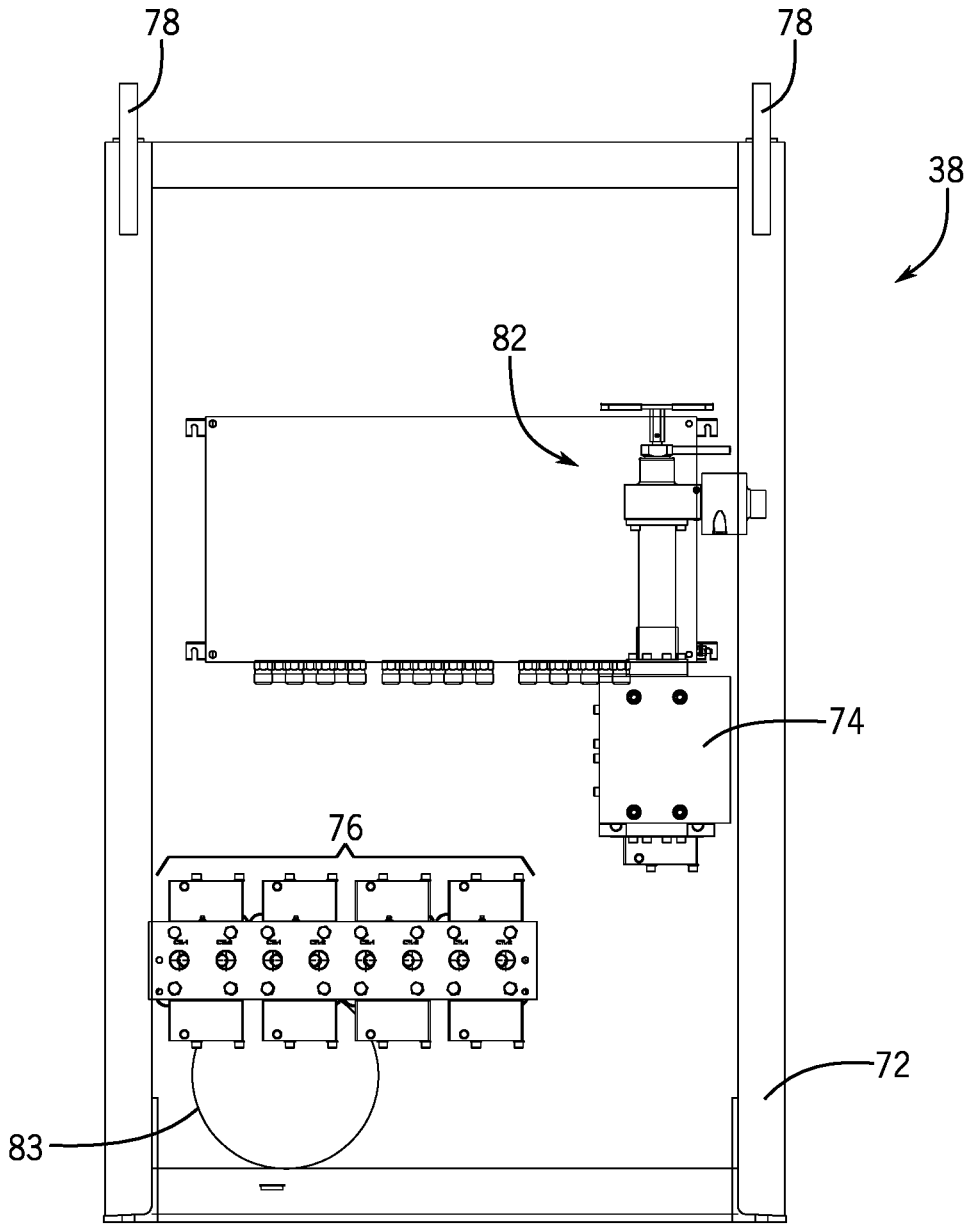
Figure 4C:
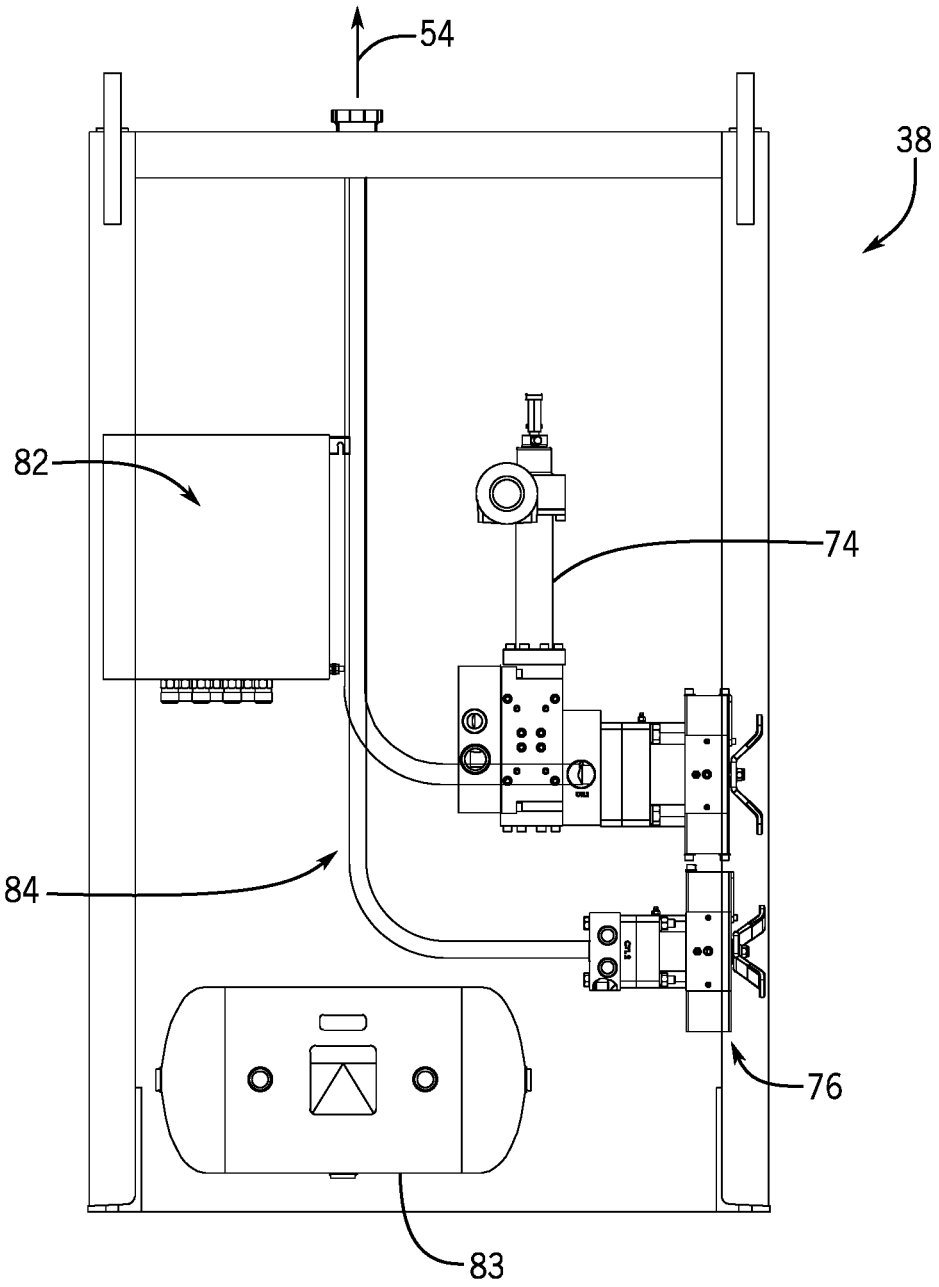
Figure 4D:
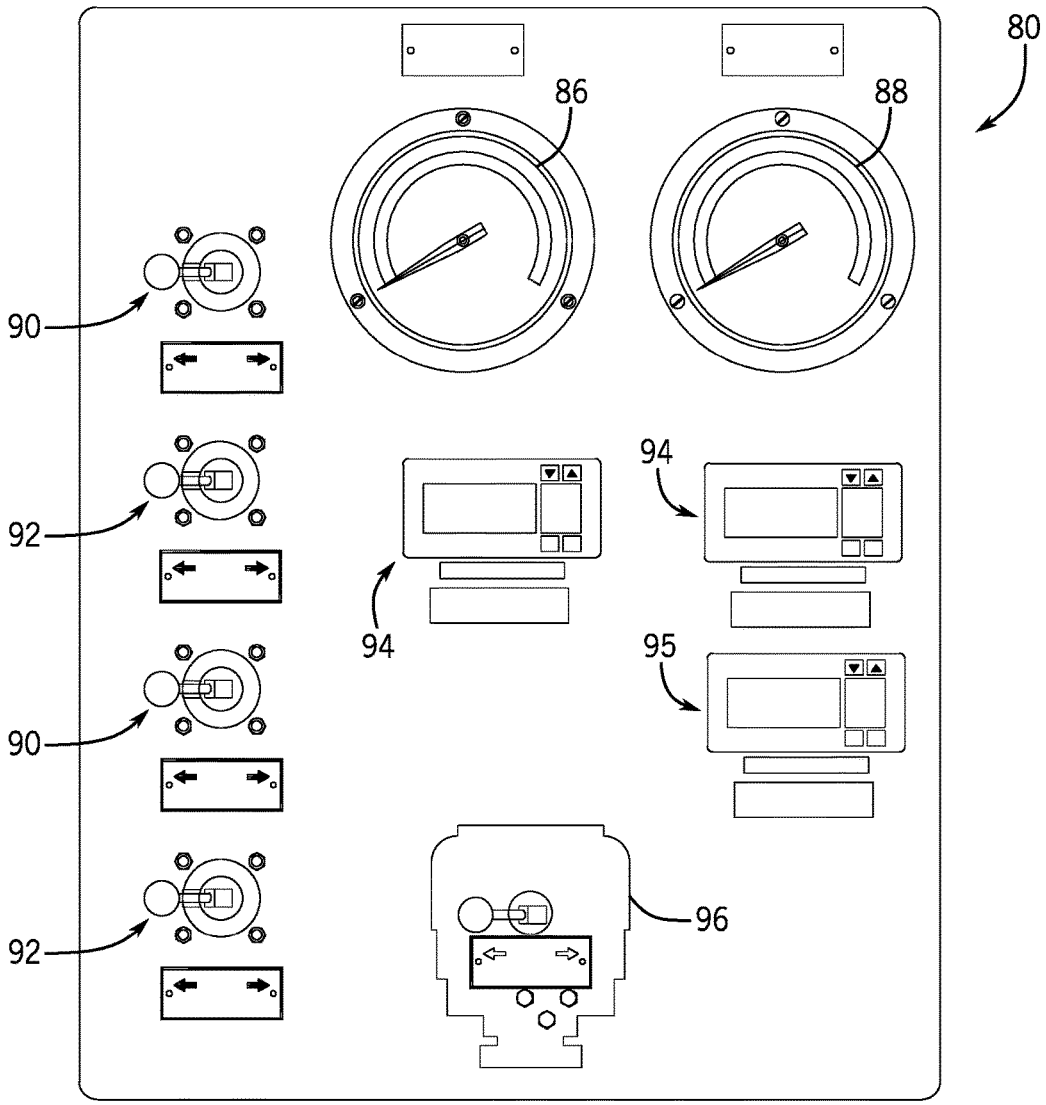

Main control module 38 unites the controls for the annular BOP and overall pressure gauges into a first module having the connections and functions separated from those relating to the diverter and ram BOPs. The main control module 38 can include controls for choke and kill valves, a pressure gauge for air supply pressure provided to the BOP control unit 34, a pressure gauge for BOP annular pressure, and a manifold regulator (i.e., regulating valve). FIGS. 4A-4D depict aspects of a main control unit module 38 in accordance with one embodiment. FIG. 4A provides a front view of the main control unit module 38. FIG. 4B provides a rear view of the main control unit module 38. FIG. 4C shows a side view of the main control unit module 38, and FIG. 4D is an example control panel on the main control unit module 38.

Turning to FIG. 4A, components of the main control unit module 38 are contained within a steel module frame 72. In the module frame 72, an annular BOP regulator 74 is provided, as well as a bank of valves 76. The annular BOP regulator 74 may comprise the type of valve conventionally used to regulate the closing pressure for the annular BOP. The main control unit module 38 further includes a control panel 80 that provides various switches, valves, and gauges, discussed in further detail below.

Any portion of the bank of valves 76 may be reserved as spare, in an embodiment, for customization of the main control unit module 38 to a particular rig (e.g., a jack-up rig). Alternatively, the valves 76 may be dedicated to particular functions. In an embodiment, the valves 76 may be selected from commercially available valves and positioned removably in the main control unit module 38 for ease of repair.

The module frame 72 also includes a lifting assembly 78. In the embodiment shown, the lifting assembly 78 includes a steel attachment (such as, e.g., a lifting eye) to the module frame 72 that enables ready connection of the module frame 72 to a crane at a rig for placement and/or removal of the main control unit module 38.

The rear view in FIG. 4B shows the rear of annular BOP regulator 74 and the rear connection-side of the bank of valves 76. The rear side of control panel 80 couples to a modular input/output unit 82, which can include a pneumatic valve island coupled to rig air supply 52 or an air tank 83 of the module. The side view in FIG. 4C shows the modular input/output unit 82, as well as a pipe interface 84 coupling from the rear of BOP annular regulator 74 and bank of valves 76 to the top of main control unit module 38. Pipe interface 84 provides the relevant connectors without wasting rig time to determine efficient cabling/piping for a given rig or jack-up configuration.

The control panel 80 shown in FIG. 4D is used in a particular embodiment, and the gauges and switches shown could be substituted for alternative functions. The functions on the control panel 80 are generally directed to the control and monitoring of the annular BOP (or pair of annular BOPs) of the stack equipment 18 of FIG. 1A. In the embodiment shown, the control panel 80 includes an air supply pressure gauge 86 (for indicating air supply pressure to the BOP control unit) and an annular BOP pressure gauge 88. The pressure gauges 86 and 88 may be ergonomically positioned near the top of the control panel 80 (e.g., about eye-level). Choke valve switches 90 and kill valve switches 92 (e.g., manual levers for control valves) are provided for controlling choke and kill line valves. The control panel 80 also includes hydraulic supply flowmeter gauges 94, for maintaining a view of the flow of hydraulic fluid to the annular BOPs, as well as a hydraulic return flowmeter gauge 95, for maintaining a view of the hydraulic fluid return line. The control panel 80 further includes an annular BOP packer control switch 96 that activates the packer.

A diverter valve module 42 collects the controls for the diverter and pressure gauges relating thereto into a second module having the connections and functions separated from those relating to the annular and ram BOPs. In some embodiments, the diverter valve module 42 includes pressure gauges, one or more regulators, and a diverter panel. The pressure gauges of the diverter valve module 42 can include any combination of the following: a diverter accumulator pressure gauge, a diverter manifold pressure gauge, a diverter packer pressure gauge, a diverter system pressure gauge, an overshot packer pressure gauge, and a flowline seals pressure gauge. The functions of the pressure gauges are self-explanatory and readily identifiable by one of ordinary skill in the art. A regulator of the diverter valve module can include one or more of a diverter manifold regulator, an overshot packer regulator, and a flowline seal regulator, each of which are readily known by function to one of ordinary skill in the art.

Figure 5A:
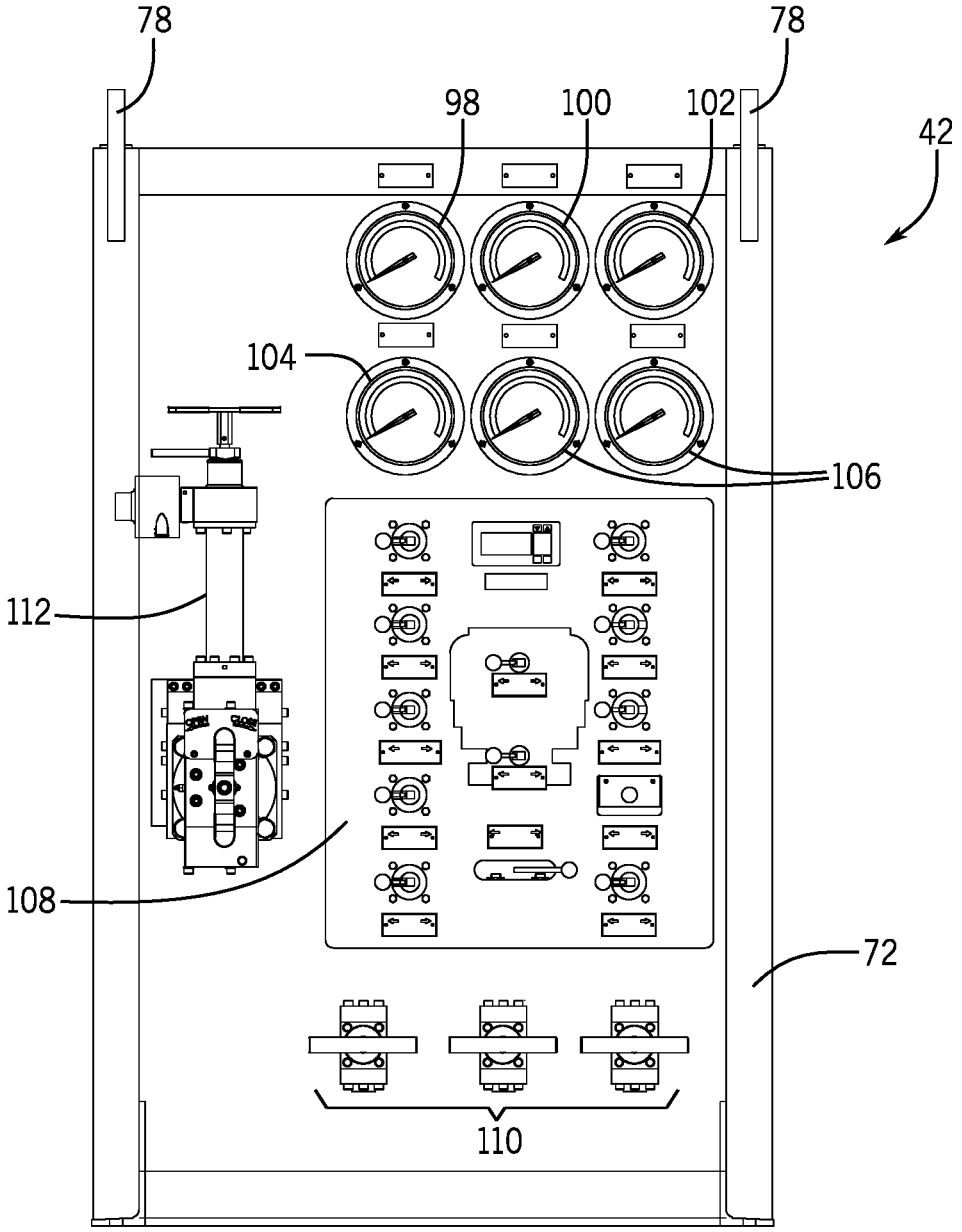
FIGS. 5A-5D depict aspects of a diverter valve module in accordance with one embodiment.
Figure 5B:
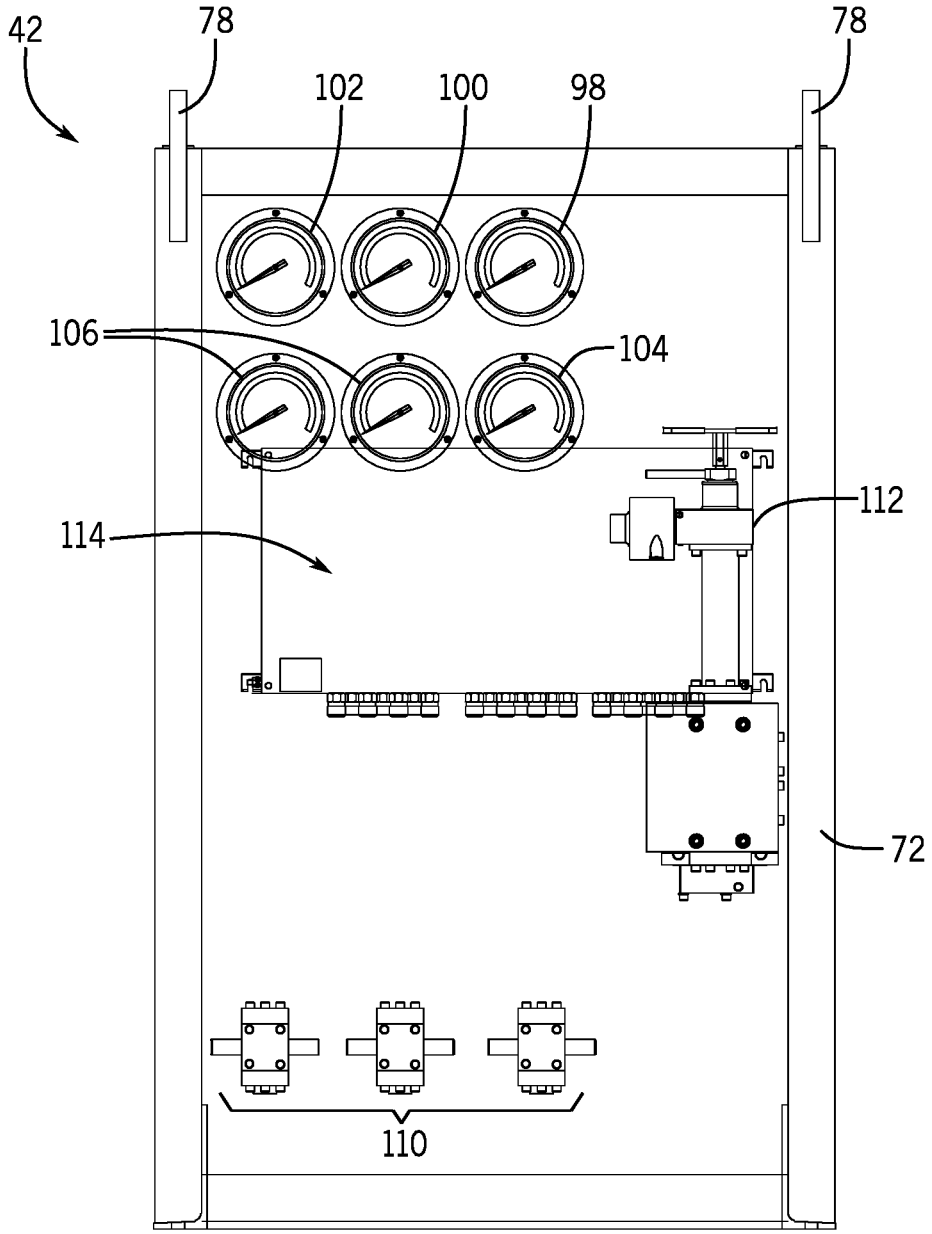
Figure 5C:
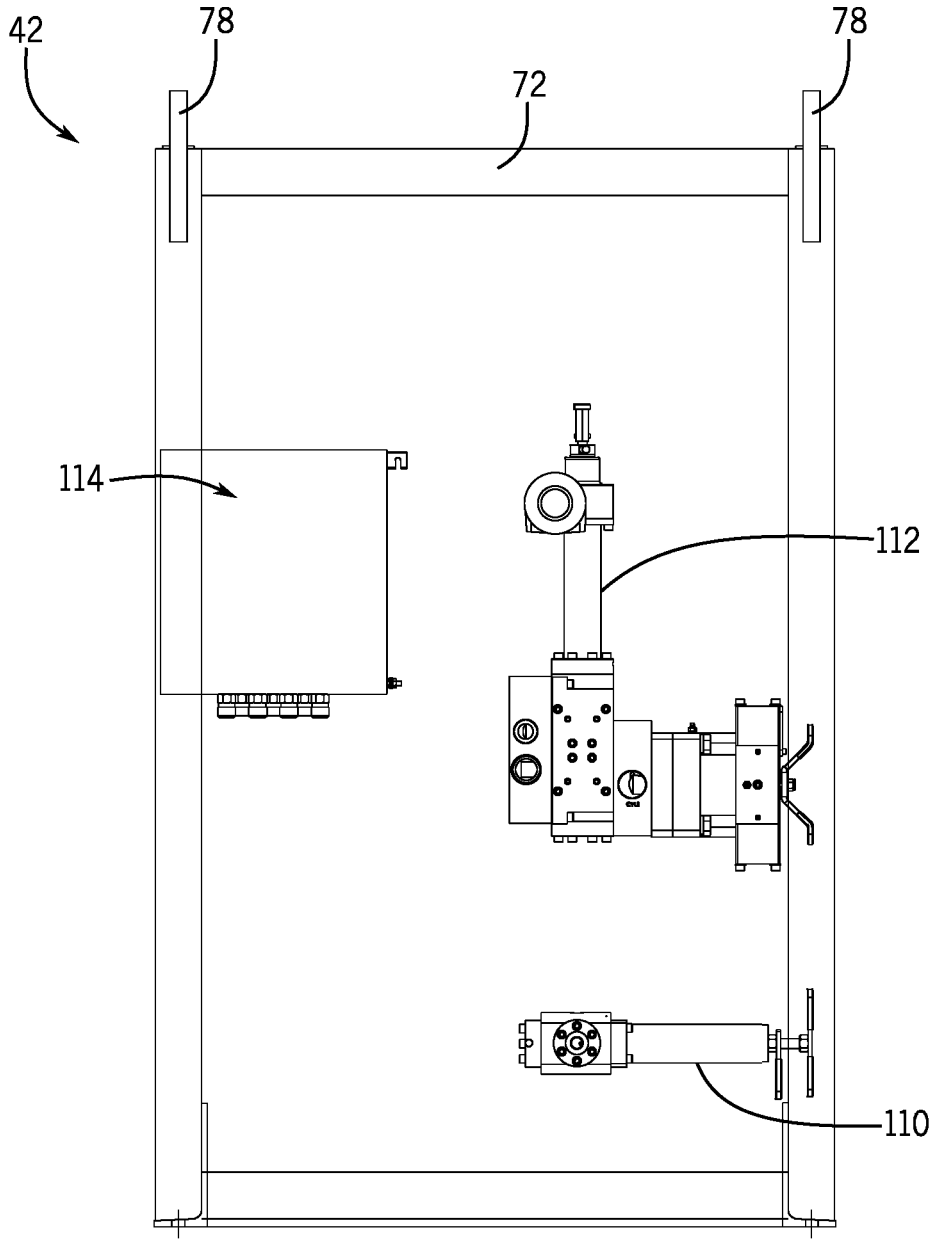
Figure 5D:
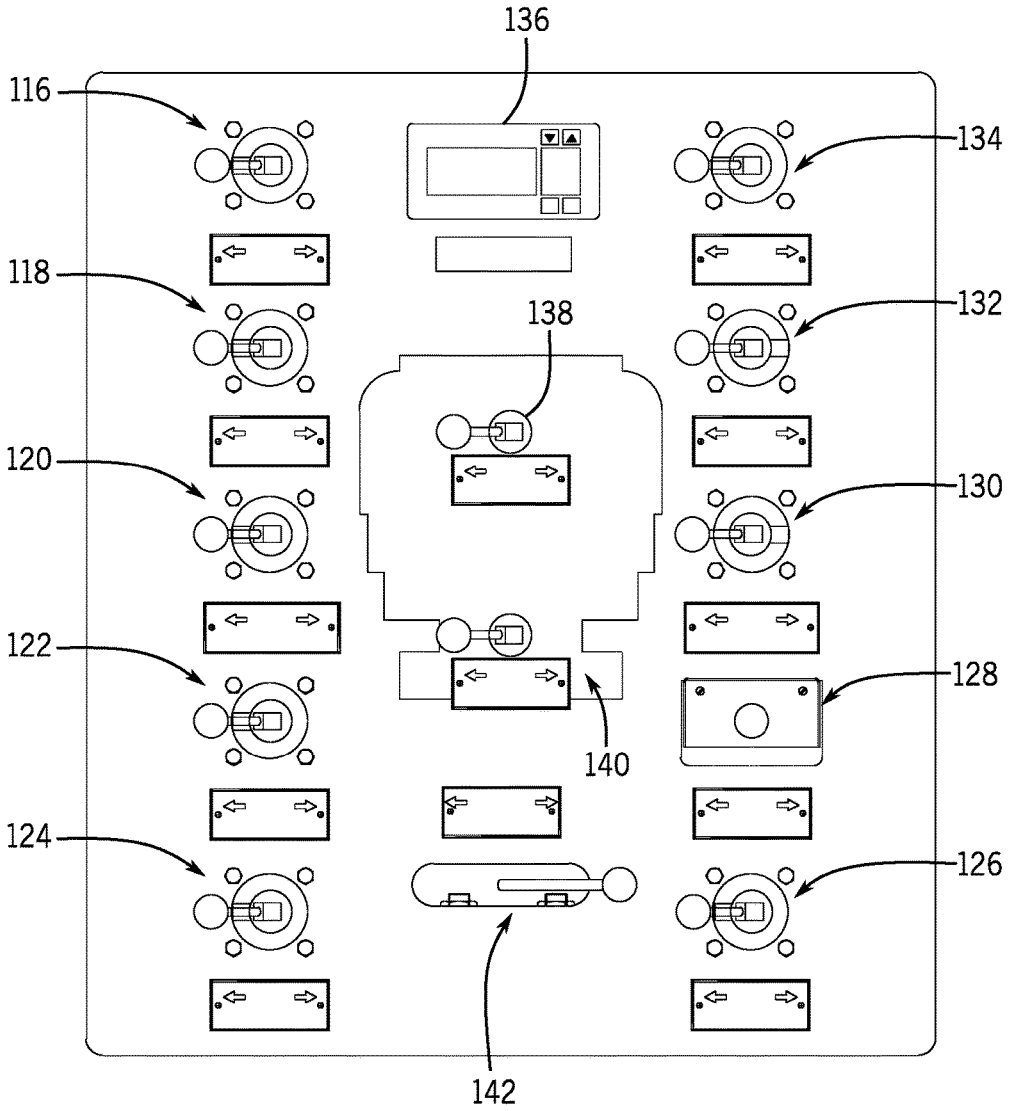

FIGS. 5A-5D depict aspects of a diverter valve module 42 in accordance with one embodiment. FIG. 5A provides a front view of the diverter valve module 42. FIG. 5B provides a rear view of the diverter valve module 42. FIG. 5C shows a side view of the diverter valve module 42 and FIG. 5D is an example diverter panel 108 on the diverter valve module 42.

Turning to FIG. 5A, components of the diverter valve module 42 are contained within a steel module frame 72. In the module frame 72, a diverter regulator 112 is provided, as well as a bank of valves 110. The diverter regulator 112 may include any combination of the following: a diverter manifold regulator (as shown), an overshot packer regulator (not shown), and a flowline seal regulator (not shown). Regulators may be selected from commercially available valves used to regulate the relevant pressure, as well established in the art. The removable bank of valves 110 may be reserved as spare, in an embodiment, for customization of the diverter valve module 42 to a particular rig. Alternatively, the bank of valves 110 may be dedicated to particular functions.

As in FIG. 4A, the module frame 72 includes a lifting assembly 78. The diverter valve module 42 further includes a diverter panel 108 that provides controls such as various switches, valves, and gauges, which will be discussed more fully below. In addition to the diverter panel 108, various gauges are positioned for ergonomic and efficient monitoring of the diverter, including a diverter manifold pressure gauge 98, a diverter packer pressure gauge 100, a diverter system pressure gauge 102, and an overshot packer pressure gauge 104. The functions of the pressure gauges are self-explanatory and readily identifiable by one of ordinary skill in the art. Spare pressure gauges 106 can be included in the diverter valve module 42 in an embodiment, for customization to a particular rig. For example, spare pressure gauges 106 may optionally be used for a diverter accumulator pressure gauge or flowline seals pressure gauge.

In the rear view, FIG. 5B shows the rear of diverter regulator 112 and the rear connection-side of the bank of valves 110. The rear side of diverter panel 108 couples to a modular input/output unit 114 (including, for example, a commercially available valve island). The side view in FIG. 5C shows the modular input/output unit 114.

The diverter panel 108 is shown in FIG. 5D in greater detail. Diverter panel 108 is used in a particular embodiment, but the gauges and switches shown could be substituted for alternative functions. The functions on the diverter panel 108 are generally directed to the control and monitoring of the diverter of the riser equipment 16 of FIG. 1A. In the embodiment shown, the diverter panel 108 includes switches (e.g., levers of control valves) for the diverter functions including any combination of the following: a flowline seal 116, a flowline valve 118, an insert packer locking dog switch 120, test line valve 122, port overboard switch 124, starboard overboard switch 126, test line valve 128, diverter lockdown dogs switch 130, filling line valve 132, overshot packer seal switch 134, diverter packer switch 138, packer pressure switch 140, and overboard preselect switch 142. The functions of these switches are self-explanatory and readily identifiable by one of ordinary skill in the art. Diverter flowmeter gauge 136 indicates measured flow through the diverter.

The BOP valve module 40 places the controls for the ram BOPs and pressure gauges relating thereto into a third module having the connections and functions separated from those relating to the annular BOP and diverter. The BOP valve module 40 can include a second set of pressure gauges (separate from and in addition to pressure gauges found on the other modules), a set of ram control valves, and a BOP manifold regulator. The second set of pressure gauges of the BOP valve module comprises any combination of the following: a BOP accumulator pressure gauge, a BOP system pressure gauge, and a BOP manifold pressure gauge. The functions of the pressure gauges are self-explanatory and readily identifiable by one of ordinary skill in the art.

Figure 6A:
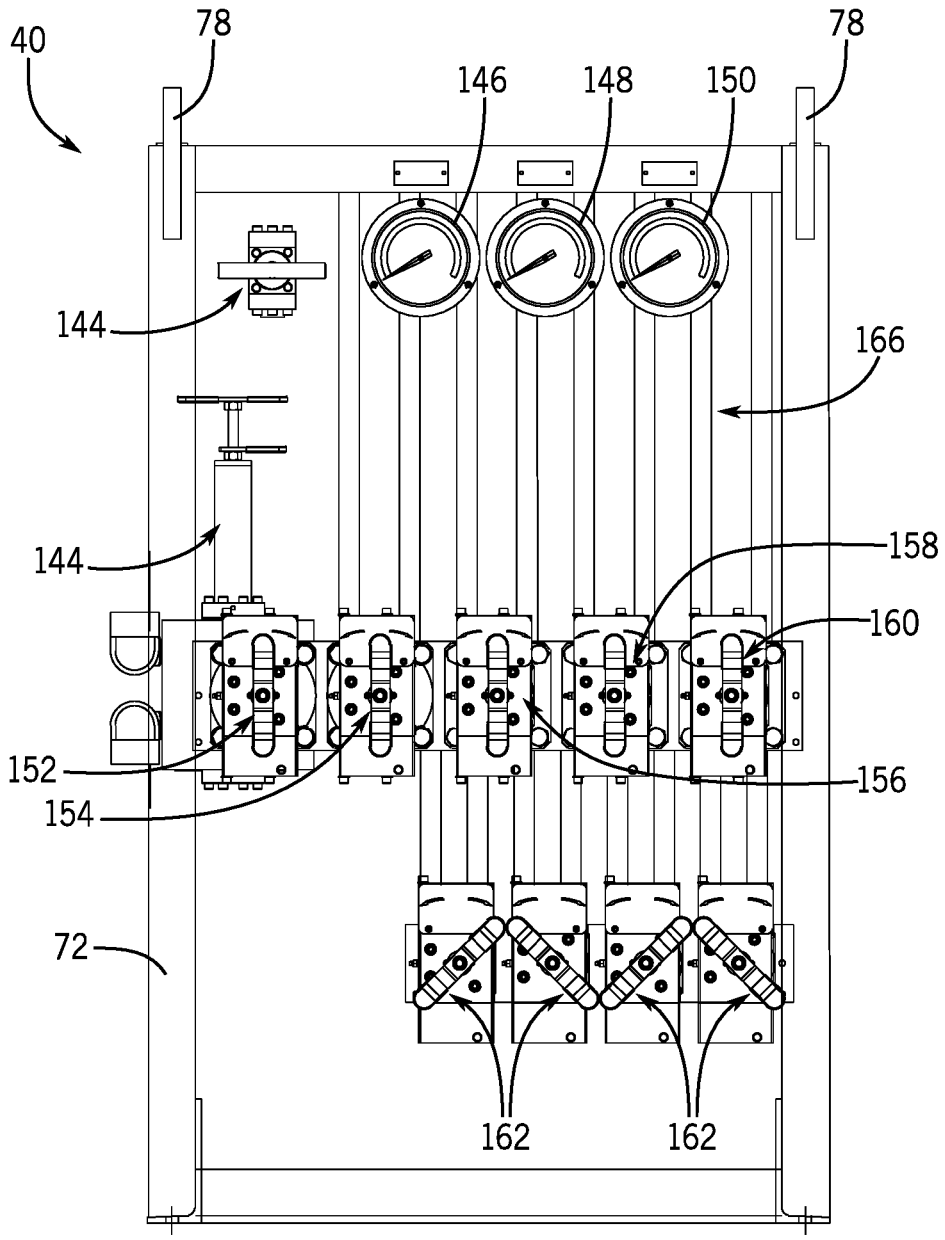
FIGS. 6A-6D depict aspects of a BOP valve module in accordance with one embodiment.
Figure 6B:
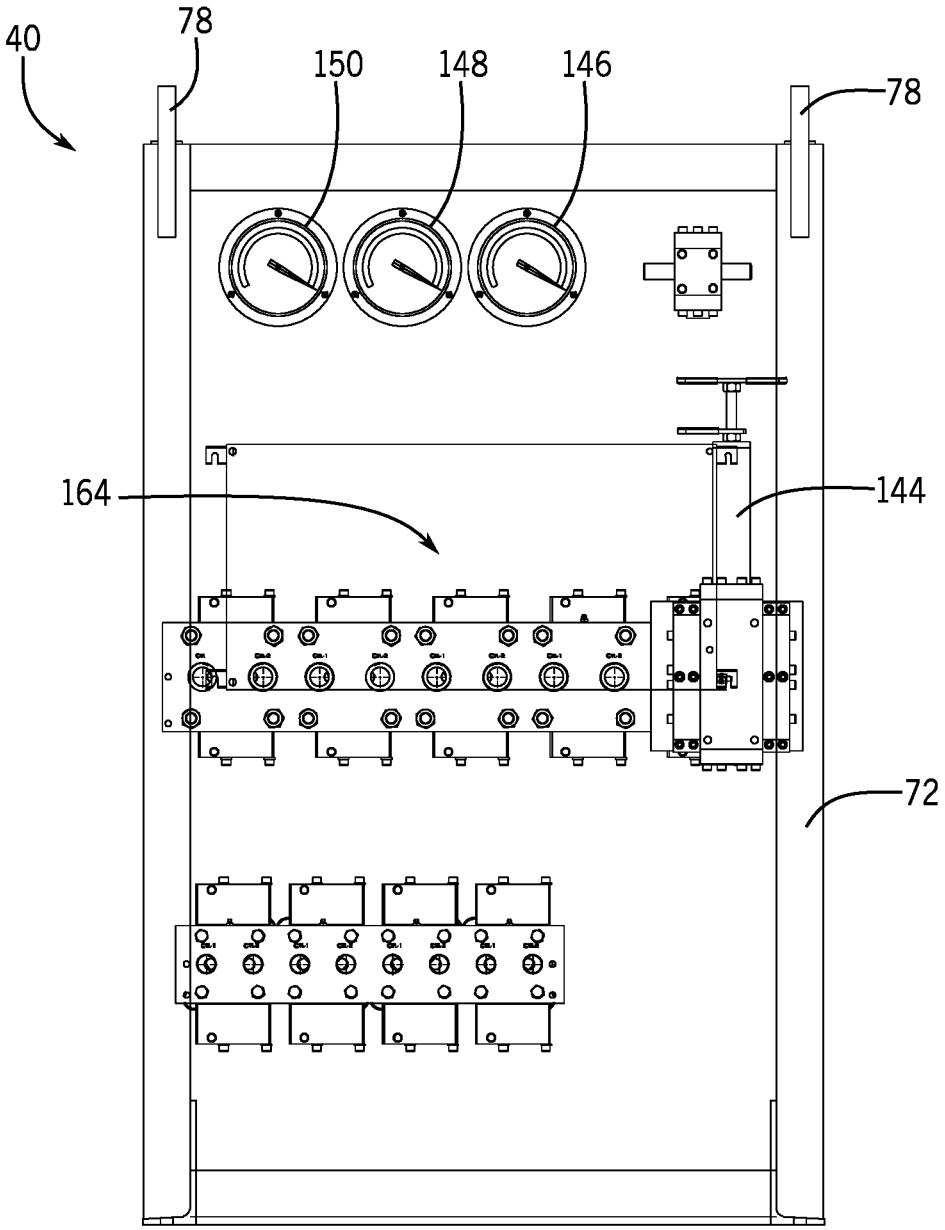
Figure 6C:
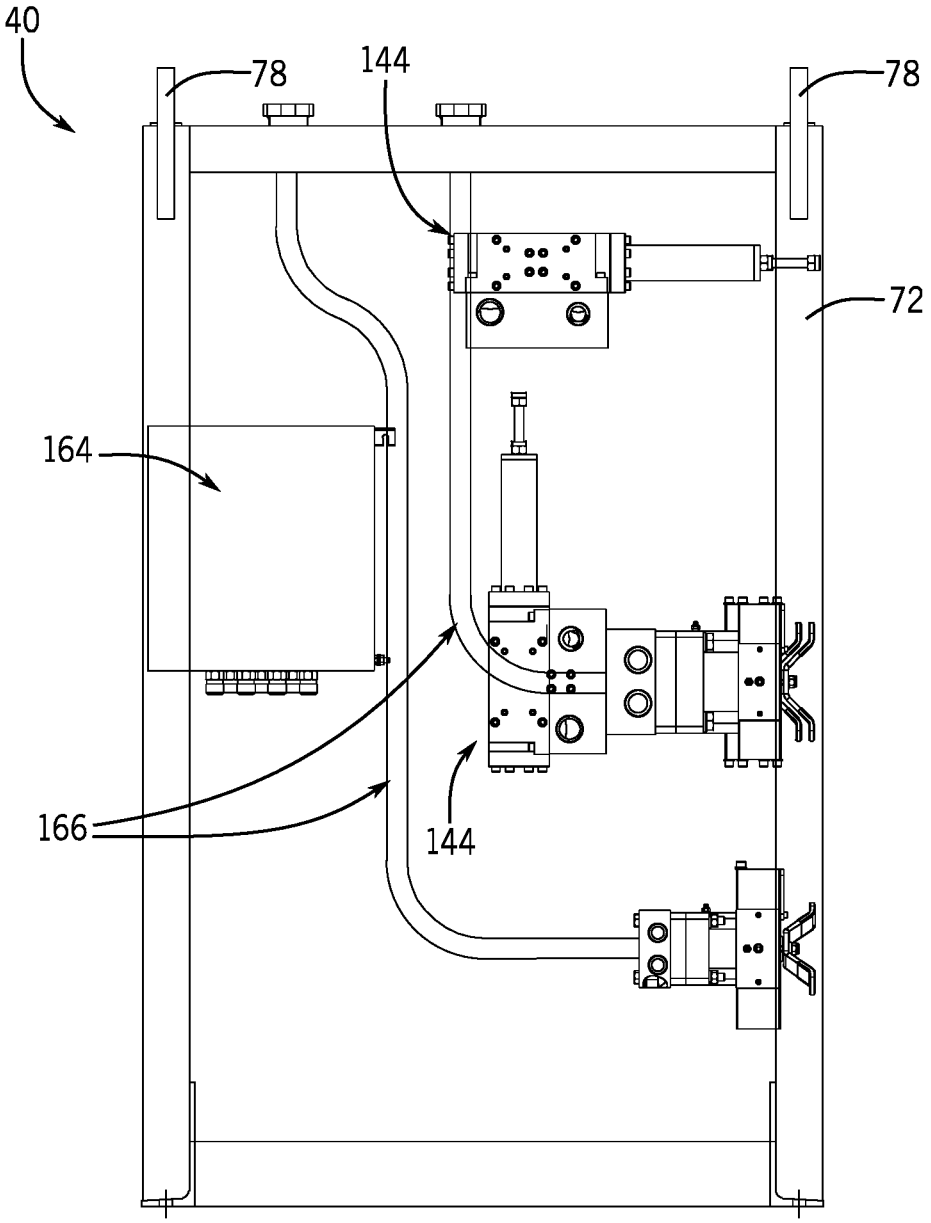
Figure 6D:
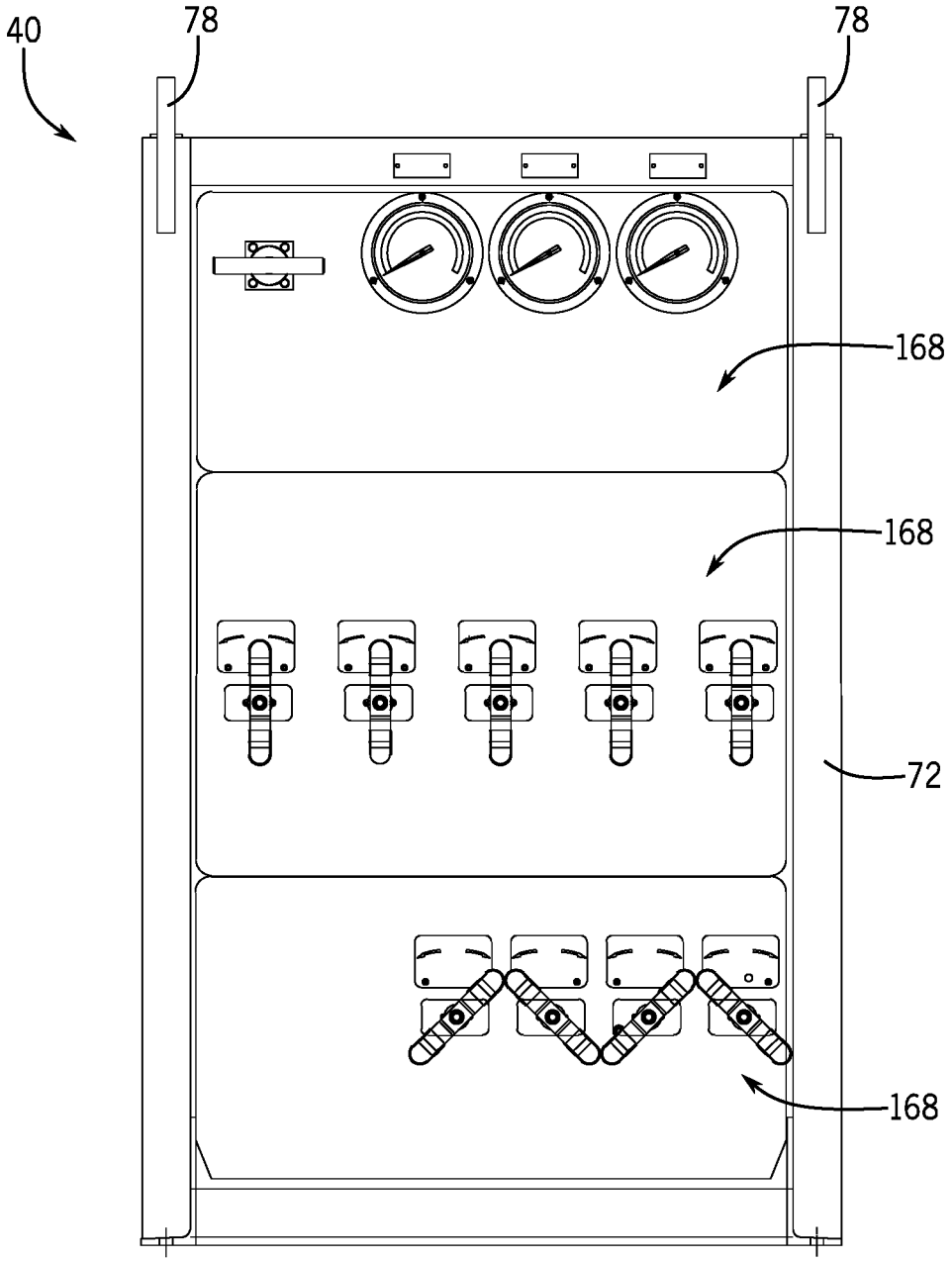

FIGS. 6A-6D depict aspects of a BOP valve module 40 in accordance with some embodiments. FIG. 6A provides a front view of the BOP valve module 40. FIG. 6B provides a rear view of the BOP valve module 40. FIG. 6C shows a side view of the BOP valve module 40. FIG. 6D shows an alternative front view embodiment of the BOP valve module 40 demonstrating the disclosed splash barriers.

Turning now to FIG. 6A, components of the BOP valve module 40 are contained within a steel module frame 72. As in FIG. 4A, the module frame 72 includes a lifting assembly 78 to enable lifting and placement of the module in the module pocket 58 of the skid 36. In the module frame 72, BOP manifold regulators 144 are provided, as well as a set of gauges. The BOP manifold regulators 144 are used to regulate the closing pressure to the BOP manifold. In the embodiment shown, the set of gauges includes a BOP accumulator pressure gauge 146, a BOP system pressure gauge 148, and a BOP manifold pressure gauge 150.

The BOP valve module 40 can include a series of control valves as well, for controlling the rams of the various BOPs in the stack equipment 18. The valves may include any combination of the following: a bypass valve 152, a blind/shear valve 154, an upper ram valve 156 to activate an upper ram, a middle ram valve 158 to activate a middle ram, and a lower ram valve 160 to activate a lower ram. Valves for ram locks may also be included as ram lock valves 162. Spare valves or other controls may be reserved, in an embodiment, for customization to a particular rig.

In the rear view, FIG. 6B shows the rear of BOP manifold regulator 144 and rear connection-side of the valves. The rear side of diverter panel 108 couples to a modular input/output unit 164 (including, for example, a commercially available valve island). The side view in FIG. 6C shows the modular input/output unit 164 and pipe interface 166 coupling from the rear of BOP manifold regulator 144 and the valves to the top of BOP valve module 40. In an alternative embodiment, the pipe interface 166 can couple from the rear of BOP manifold regulator 144 and the valves to the rear side of BOP valve module 40.

FIG. 6D shows an alternative embodiment of the front of BOP valve module 40 that can include splash barriers 168 on the front of the module. Though not explicitly illustrated with respect to main control unit module 38 or BOP valve module 40, analogous splash barriers 168 are contemplated as optional components of each other module. The splash barriers 168 may comprise, for example, a heat-resistant, corrosive-resistant material.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A modular blowout preventer (BOP) control system for controlling an annular BOP, a diverter, and one or more ram BOPs, the modular BOP control system comprising:

a skid; and a group of modular units each having a frame that is mounted on the skid, the group of modular units comprising:

a main control unit module that controls and monitors the annular BOP;

a diverter valve module that controls and monitors the diverter and comprises a set of pressure gauges relating to the diverter; a regulator that regulates closing pressure for the diverter; and a diverter panel; and a BOP valve module that controls and monitors one or more ram BOPs wherein the regulator of the diverter valve module comprises one or more of:

a diverter manifold regulator that regulates closing pressure for the diverter;

an overshot packer regulator that regulates closing pressure for a packer; or a flowline seal regulator that regulates pressure to flowline seals.

2. The system according to claim 1, wherein the main control unit module comprises:

a pressure gauge for air supply pressure to the BOP control system;

a pressure gauge for annular BOP pressure; and an annular BOP regulator that regulates closing pressure for the annular BOP.

3. The system according to claim 1, wherein the main control unit module further comprises a choke valve switch and a kill valve switch.

4. The system according to claim 1, wherein the set of pressure gauges of the diverter valve module comprises one or more of:

a diverter accumulator pressure gauge;

a diverter manifold pressure gauge;

a diverter packer pressure gauge;

a diverter system pressure gauge;

an overshot packer pressure gauge; or a flowline seals pressure gauge.

5. The system according to claim 1, wherein the BOP valve module comprises:

a set of pressure gauges relating to the one or more ram BOPs;

a set of ram control valves relating to the one or more ram BOPs; and a BOP manifold regulator that regulates closing pressure to a BOP manifold.

6. The system according to claim 5, wherein the set of pressure gauges of the BOP valve module comprises at least two of:

a BOP accumulator pressure gauge;

a BOP system pressure gauge; or a BOP manifold pressure gauge.

7. The system according to claim 5, wherein the set of ram control valves of the BOP valve module comprises at least two of:

a bypass valve;

a blind/shear valve;

an upper ram valve;

a middle ram valve; or a lower ram valve.

8. The system according to claim 1, wherein the skid comprises a plurality of module pockets configured to receive the group of modular units.

9. The system according to claim 8, wherein each of the plurality of module pockets comprises a hydraulic connection and an electrical connection.

10. The system according to claim 1, wherein the skid comprises hydraulic interconnects for connecting the modular units.

11. The system according to claim 1, wherein the skid comprises cabling for communication or power between the modular units.

12. The system according to claim 1, wherein at least one modular unit further comprises a splash barrier.

13. The system according to claim 1, wherein each modular unit further comprises a dedicated lifting attachment.

14. A method comprising:

positioning a skid over a wellhead, the skid comprising an upper surface having a plurality of module pockets;

lowering each of at least three modular units into a respective module pocket of the skid, wherein the at least three modular units comprise: a main control unit module, a diverter valve module and a BOP valve module; and upon failure of any single modular unit, lifting the failed modular unit out of its module pocket and replacing the failed modular unit with a replacement modular unit;

wherein the diverter valve module comprises a set of pressure gauges relating to the diverter; a regulator that regulates closing pressure for the diverter; and a diverter panel; and wherein the regulator of the diverter valve module comprises one or more of:

a diverter manifold regulator that regulates closing pressure for the diverter;

an overshot packer regulator that regulates closing pressure for a packer; or a flowline seal regulator that regulates pressure to flowline seals.

15. The method of claim 14; wherein the plurality of module pockets further comprises an accumulator system module, and a BOP selector module, and wherein the method comprises lowering the accumulator system module and the BOP selector module into a respective module pocket of the skid; and upon failure of the accumulator system module or the BOP selector module, lifting the failed modular unit out of its module pocket and replacing the failed modular unit with a replacement modular unit.

16. The method according to claim 14, wherein each module pocket comprises at least one hydraulic connection and at least one electrical connection.

17. The method according to claim 14, wherein lowering each of the at least three modular units into a respective module pocket of the skid further comprises using a dedicated lift assembly of each of the at least three modular units.

18. The method according to claim 14, further comprising connecting the replacement modular unit to hydraulic interconnects for connecting through the skid.

19. The method according to claim 14, further comprising interconnecting the replacement modular unit with at least one other modular unit received on the skid via skid cabling for communication or power through the skid.

* * * * *